United States Patent [19]

Barton

[11] 4,230,163

[45] Oct. 28, 1980

[54] LOG-PLANING MACHINE

[75] Inventor: Edwin A. Barton, Colchester, Conn.

[73] Assignee: Vermont Log Building, Inc., Hartland, Vt.

[21] Appl. No.: 881,361

[22] Filed: Feb. 27, 1978

[51] Int. Cl.[3] ..... B27C 1/08

[52] U.S. Cl. ..... 144/116; 144/3 R; 144/122; 144/137; 144/142; 144/246 R; 144/326 R

[58] Field of Search ..... 144/208 R, 2 Z, 1 R, 144/2 R, 2 D, 3 R, 37, 39, 41, 114 R, 116, 117 R, 117 B, 118, 134 R, 137, 246 R, 144 A, 142, 312, 323, 326 R, 122, 121

[56] References Cited

U.S. PATENT DOCUMENTS

| | | | |
|---|---|---|---|
| 769,980 | 9/1904 | Borg | 144/142 |
| 1,825,041 | 9/1931 | Babare | 144/39 |
| 2,232,416 | 2/1941 | Taylor et al. | 144/114 R |
| 3,554,247 | 1/1971 | Larsen | 144/117 B |
| 3,841,367 | 10/1974 | Vizziello et al. | 144/3 R |
| 3,871,478 | 3/1975 | Peterson | 144/117 B |
| 3,916,965 | 11/1975 | Attridge et al. | 144/117 B |
| 3,934,630 | 1/1976 | Cockle | 144/3 R |

FOREIGN PATENT DOCUMENTS

| | | | |
|---|---|---|---|
| 639068 | 6/1950 | United Kingdom | 144/142 |

*Primary Examiner*—W. Donald Bray
*Attorney, Agent, or Firm*—Charles E. Pfund

[57] ABSTRACT

Apparatus for surface cutting logs to provide a finished surface corresponding to the natural surface contour of the log or to impart a predetermined distinctive surface contour thereto and a method of effecting such surface contouring; said apparatus comprising log guiding and feeding means for moving a log planed at diametrically opposite sides to have spaced parallel top and bottom surfaces and diametrically opposed debarked side surfaces or a log planed on all four sides so as to have spaced parallel top and bottom surfaces and spaced parallel side surfaces, cutting instrumentalities located at longitudinally spaced intervals along the path of movement of the log at different peripheral positions which collectively remove material from the side surfaces and guides associated with the cutting instrumentalities operable to control movement of the cutting instrumentalities in accordance with deviations in the surface of the log or according to a predetermined programmed pattern.

39 Claims, 15 Drawing Figures

M

LOG-PLANING MACHINE

BACKGROUND OF INVENTION

Precut logs for use in constructing log cabins, lodges, shelters and the like may be made from logs which have been planed and grooved on two opposite sides and debarked on the other two sides or from logs which have been planed and grooved on two opposite sides and planed on the other two opposite sides. In the first instance, the debarking produces nicks, cuts and the like in the side surfaces and one of the objects of the invention is to provide apparatus for removing the blemishes without spoiling the natural contour of the side surfaces and in the second instance, it is desirable to provide apparatus capable of imparting to the side surfaces a surface contour simulating a natural log or to impart to the side surfaces some distinctive surface pattern other than that of a natural log. Other objects are to provide apparatus capable of cutting one or both sides of a log so that, for example, the outer side appears to be a log structure and the inner side is smooth and to provide for making the top surfaces of the log narrower than the bottom surfaces so that, when stacked, the bottom surface of any given log will overhang the top surface of the log immediately therebelow.

SUMMARY OF INVENTION

As herein illustrated, the apparatus comprises means supporting, guiding and moving a log along a predetermined rectilinear path in a substantially horizontal plane, cutting means located at longitudinally-spaced intervals along said path for operating on the side surfaces of the log at different circumferential positions relative to the axis of the log for making cuts in different planes circumferentially of the log and means associated with the first of the cutting means to cause the cutting means to make cuts following the longitudinal deviations in the surface to remove from said surface a layer of predetermined thickness and means associated with successive cutting means arranged by engagement with the contour of the cuts made by the first cutting means to cause the successive cutting means to follow the contour of the cuts made by the first cutting means. The means for effecting cutting of the side surfaces of the log comprise rotary cutters supported for movement toward and away from the path of movement of the log, means for moving the cutters from retracted positions into operative engagement with the side surfaces of the log as it commences to travel thereby and means associated with the cutters for causing them while in operative engagement with the sides of the log to move inwardly and outwardly in conformance with the natural deviations in the surfaces of the sides of the log or according to some distinctive pattern. The means for guiding the first cutters of the series of longitudinally spaced cutters may be guides at opposite sides of the cutters which, by engagement with the side surface of the log at opposite sides of the cutters, causes the cutters to move inwardly and outwardly relative to the side surfaces and limits the depths of the cuts. The means for guiding the successive cutters are single guide shoes arranged by engagement with the cuts made by the preceding cutters to cause the cutters with which they are associated to follow the deviations in the surface cuts made by the preceding cutters. Alternatively, the first cutters may be moved inwardly and outwardly relative to the side surfaces of the log by guides in the form of cam means designed to cause the cutters to follow a predetermined random or distinctive repeat pattern independently of the contour of the side surfaces of the leg. There is means for controlling the pressure of the cutters as they are moved inwardly and outwardly so as to maintain a constant cutting pressure and means for holding the cutters at one side retracted from the path of movement of the log so that contouring is effected at one side only. The support for effecting linear movement of the logs relative to the cutters comprises longitudinally-spaced rollers rotatable about horizontal axes having ribs on their peripheral surfaces for engagement with the grooves in the top and bottom surfaces of the log for guiding rectilinearly and to resist lateral movement thereof and which are supported above the path of movement with their peripheral surfaces in frictional engagement with the top sides which, by rotation and the traction between their peripheral surfaces and the logs, move the logs forwardly along the supports. Between the longitudinally-spaced rollers at the lower side, additional supports are provided comprising flat platens which have on their surfaces upstanding ribs aligned with the ribs on the rollers for engagement with the grooves in the bottom sides of the logs.

The invention will now be described in greater detail with reference to the accompanying drawings, wherein.

Figure 1:
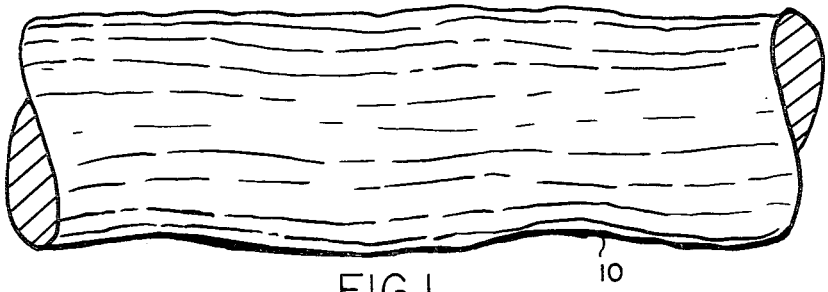
FIG. 1 is a plan view of a section of a log which has been debarked showing the surface deviations both lengthwise of the log and peripherally thereof.
Figure 2:
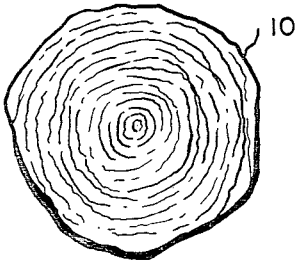
FIG. 2 is a transverse section of FIG. 1 which shows the peripheral deviations.
Figure 3:
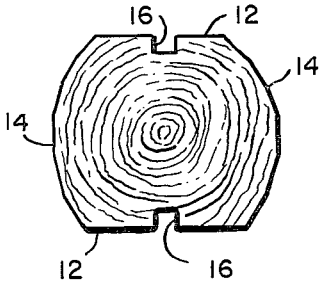
FIG. 3 shows the configuration of the log shown in FIGS. 1 and 2 after planing off the top and bottom surfaces and forming grooves in the top and bottom surfaces ready to be processed according to this invention.
Figure 4:
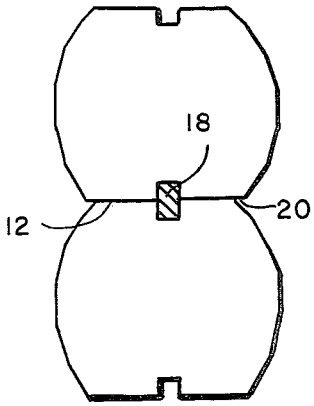
FIG. 4 is an elevation showing the piling of logs processed according to this invention, one upon another, to form, for example, the wall of a structure and formed according to this invention with the lower surface of each log wider than the upper surface to provide an overhang.

Referring to the drawings, FIGS. 1 and 2 show plan and sectional views of a natural log and FIG. 3 the log after it has been planed off at the top and bottom sides to provide flat top and bottom surfaces 12—12, grooved longitudinally at 16—16 to receive a locking strip 18 as shown in FIG. 4 for locking the logs one atop another, debarked at opposite sides and contoured at opposite sides 14—14 with the apparatus herein described to remove nicks, cuts, scars and the like produced by the debarking operation while retaining the original deviations in the side surfaces of the log.

As illustrated in FIG. 4, as a feature of the process disclosed herein, the upper surface 12 of one log is made narrower than the lower surface of the log to be placed upon it so that there is an overhang 20 at one or both sides, the purpose of which is to eliminate, especially at the outside of the structure, a place for water to collect and cause rotting.

The log shown in FIG. 3 has both of its side surfaces contoured. However, it is within the scope of the invention to contour one side surface only and leave the other side surface flat, for example, for the interior of the structure.

Figure 5:
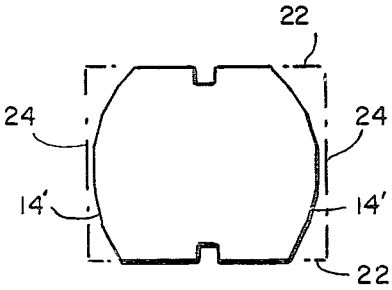
FIG. 5 is a cross section of a four square log, that is, a log which has been planed to provide spaced parallel top bottom and side surfaces and with grooves in the top and bottom surfaces subjected to processing according to this invention to provide curved side surfaces containing deviations simulating a natural log.
Figure 6:
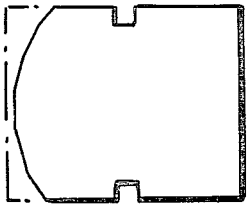
FIG. 6 is a view similar to FIG. 5 showing formation of the deviations at one side only of the log.
Figure 7:
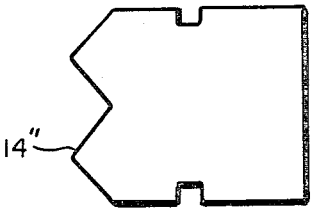
FIG. 7 is a cross section of the log showing deviations at one side only of the log which are of a predetermined configuration different from the natural deviations of the log.

Under certain circumstances, it may be economically more feasible to start with a four square log as shown in FIG. 5 having spaced parallel top and bottom surfaces 22—22 and spaced parallel side surfaces 24—24 shown in that Figure in dot and dash lines and of then, with the apparatus of this invention, cutting the side surfaces to provide curved side surfaces 14'—14' which are contoured to simulated natural surface deviations or some distinctive surface pattern as shown, for example, by the side surface 14"in FIG. 7. FIG. 6 shows the four square log of FIG. 5 contoured at one side and flat at the other.

The apparatus for accomplishing the foregoing comprises, as shown in FIGS. 8 and 10 to 14 inclusive, supporting means 24 by means of which the logs are supported in a horizontal position for movement along a predetermined rectilinear path, feeding means 26 for effecting such rectilinear movement and cutting instrumentalities 28 of which there are several located along each side of the path of movement of the log and at different distances therealong for operating on different peripheral portions of the log, the aforesaid components 24, 26 and 28 being mounted in operative relation together with driving means on a supporting structure comprising spaced, parallel, free-standing frame members 30*a*—30*a*.

Figure 10:
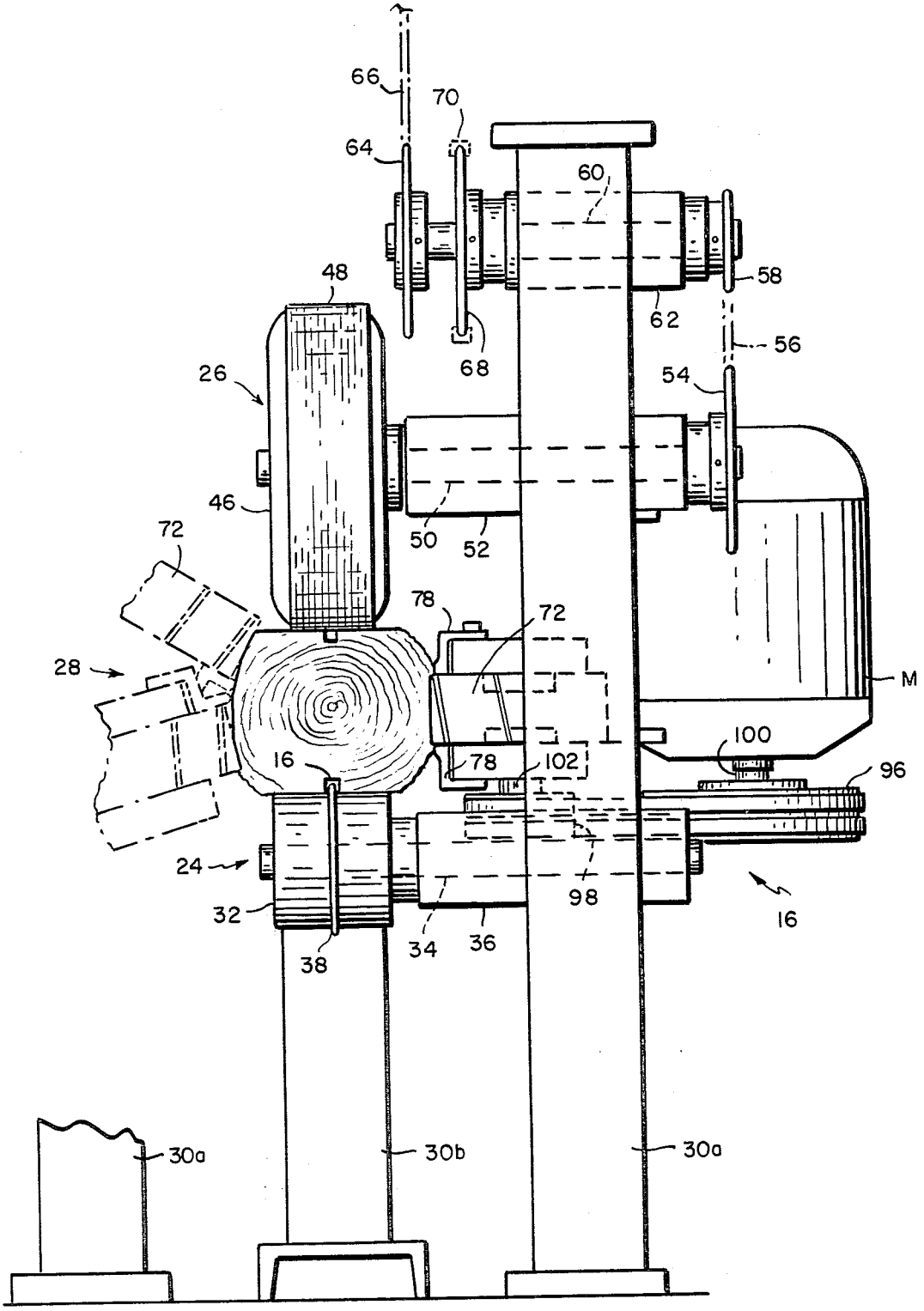
FIG. 10 is a front elevation of the planing apparatus of this invention showing the first of several cutting stations wherein the cuts are diametrically opposite and perpendicular to the path of movement of the log.
Figures 11, 12, 13:
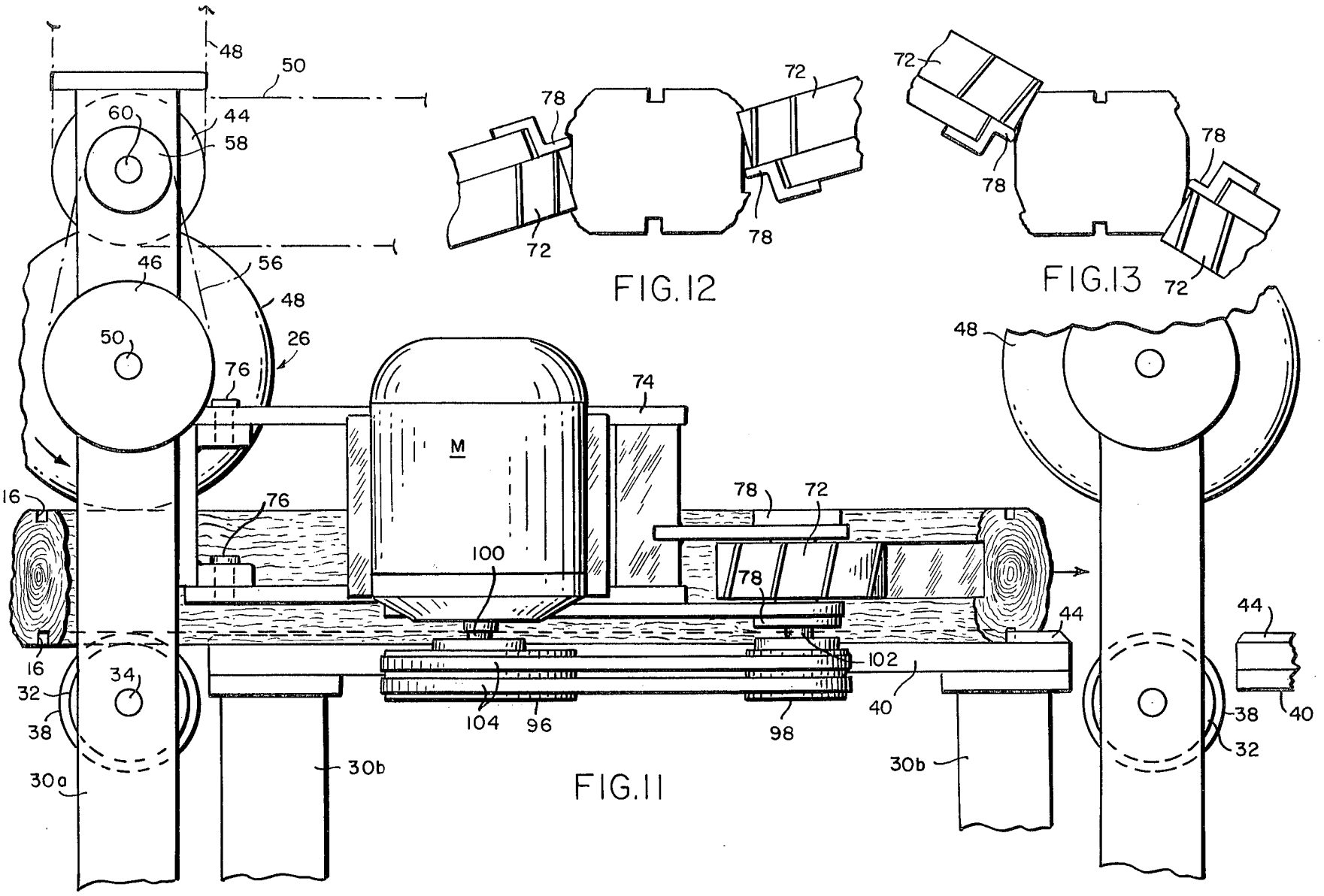
FIG. 11 is a fragmentary side elevation of the planing apparatus showing the first cutting station, there being several such stations.
FIG. 12 is a fragmentary elevation of a second planing station wherein the cuts are diametrically opposite and inclined in one direction to the path of movement of the log.
FIG. 13 is a fragmentary elevation at a third planing station wherein the cuts are diametrically opposite and inclined in the opposite direction to the path of movement of the log.

The supporting means 24, FIGS. 10 and 11, comprise a plurality of cylindrical rollers 32 mounted at longitudinally-spaced intervals on the frame members 30*a* at one side upon horizontally-supported shafts 34 mounted in bearings 36, the latter, in turn, being supported by the frame members 30*a* at one side only, thus enabling easy access to the rollers in the event that they have to be replaced. The cylindrical rollers 32 are free to turn on the shafts 34 and have on their peripheral surfaces midway between their opposite ends peripheral ribs 38 which serve to guide the logs as they are moved rectilinearly. As already explained, the logs are provided at their lower and upper sides 12—12 with grooves 16—16 and these are taken advantage of in conjunction with the ribs 38 to guide the logs linearly as they are planed to prevent lateral movement from pressure of the cutting means in the event that the cutting is carried out at one side surface only. To further guide the logs as they are planed, there are provided secondary frame members 30*b* situated midway between the frame members 30*a*—30*a* which support at their upper ends horizontal beds 40, FIG. 11, on which there are longitudinally extending ribs 44 for engagement with the groove 16 at the bottom side.

The feeding means 26 comprise wheels 46, FIGS. 6,10 & 11, herein shown as conventional automobile wheels to which there are mounted tires 48, fixed to horizontal shafts 50 rotatably mounted in bearings 52, the latter being mounted on the frame member 30*a* at one side only. A wheel 46 is provided above each of the cylindrical rollers 38 and, by frictional engagement with the upper side of the log when rotated, will move the log rectilinearly. The wheels 46 are rotated by rotating their shafts 50 and such rotation is provided for by sprockets 54 fixed to the shafts 50. The sprockets 54 are driven by chains 56 entrained at one end about the sprockets 54 and at their other ends about sprockets 58 fixed to shafts 60 rotatably journaled in bearings 62 mounted on the frame members 30*a* at one side only. One of the shafts 60 has fixed to it a sprocket 64 which is drivably connected by a chain 66 to a main drive shaft not shown. There is a sprocket 68 fixed to the shaft 60 at each of the stations longitudinally of the apparatus and a chain 70 entrained about the several sprockets provides for driving all of them from the one shaft 60.

Figure 8:
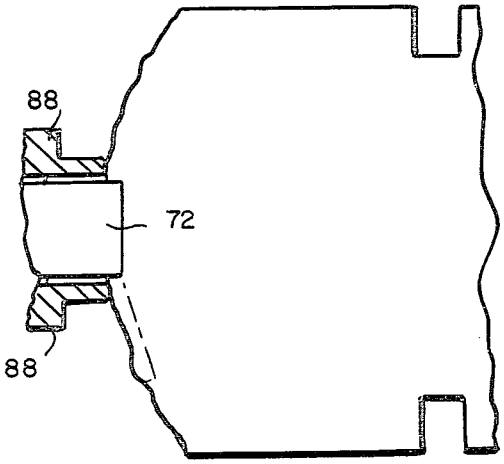
FIG. 8 is a large fragmentary section showing the entry of the first cutter into the side surface of a log and showing the guides at opposite sides of the cutter which control not only the depth of the cut, but also cause the cutter to follow the deviations in the surface of the log.
Figure 9:
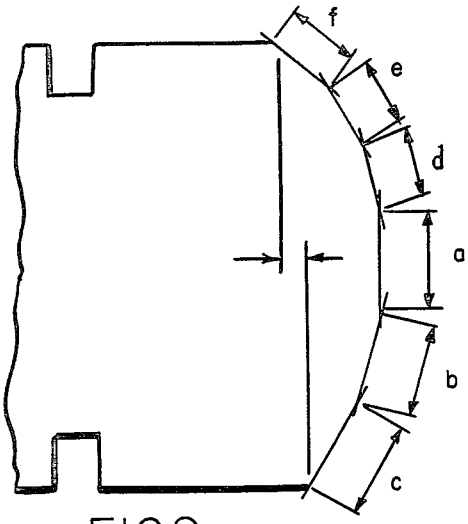
FIG. 9 is an enlarged fragmentary section similar to FIG. 8 showing as examplary only a number of cuts at different angles to the top and bottom surfaces.

The planing means 28 comprise rotary cutters 72 which are arranged at opposite sides of the log at each station for movement into engagement with the surface of the log at different peripheral positions. At the first station, FIG. 10, two cuts are taken which are diametrically opposite each other and perpendicular to the path of travel, at a second station, FIG. 12, two cuts are taken diametrically opposite each other which are inclined upwardly and to the left of the path of travel at a predetermined angle, and at a third station, FIG. 13, two cuts are taken diametrically opposite each other which are also inclined downwardly and to the left of the path of travel. The number of cutters employed and the angles of inclination will depend upon customer specification. A preferred angular arrangement of the cuts not only to provide for longitudinal deviations and peripheral deviations, but also to provide for the overhang described above and illustrated in FIG. 4 is shown in FIG. 9 wherein there is a center cut a, two angular cuts b and c below the center wherein the angular cut c intersects the bottom surface and three angular cuts above the center d, e and f, the latter cut being so arranged as to intersect the top surface at a sharper angle than the cut c so that the total width of the top surface 12 is less than the total width of the bottom surface 12.

Figures 14, 15:
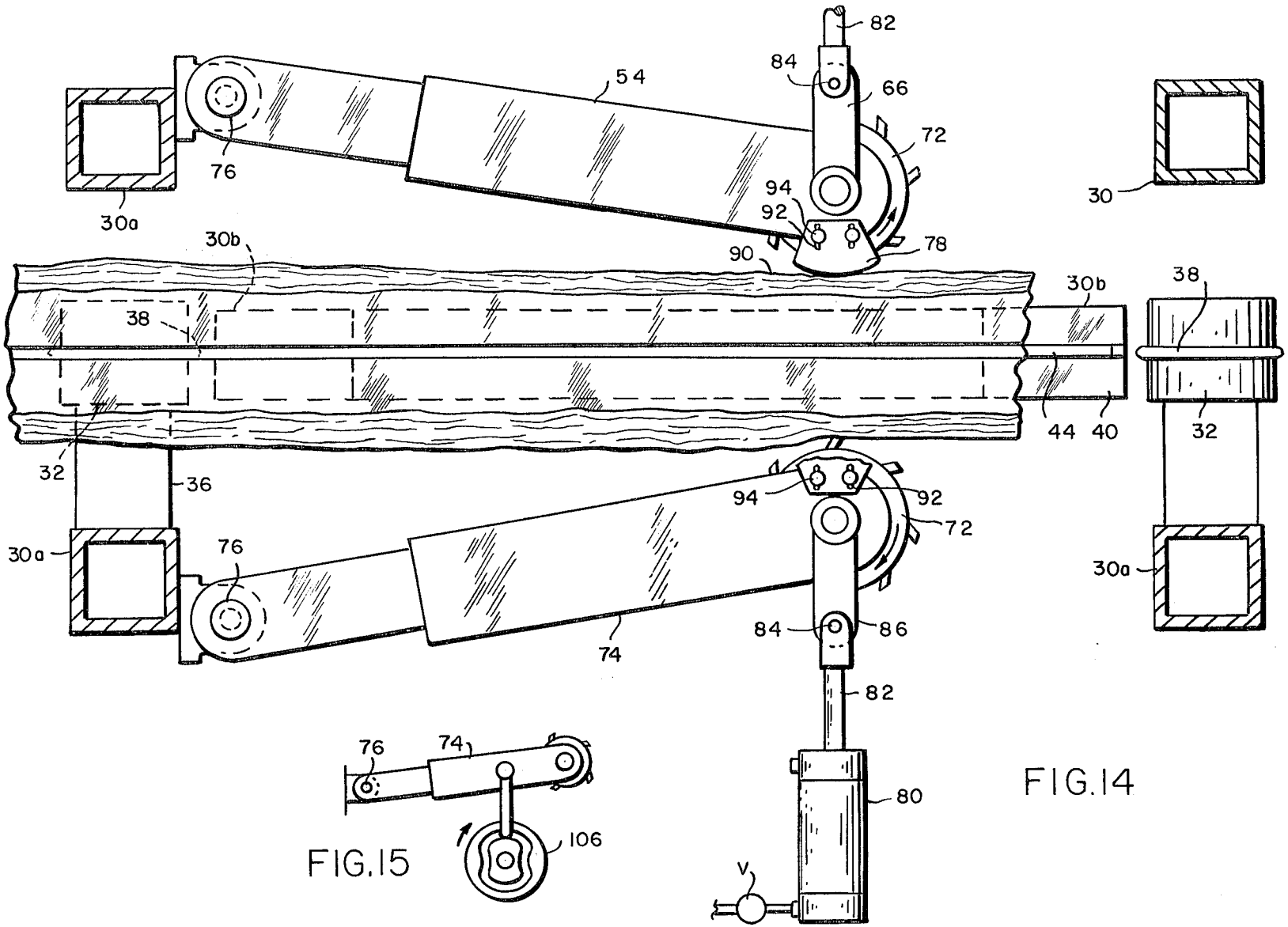
FIG. 14 is a plan view of the apparatus at one of the stations showing the supports for the cutting instrumentalities.
FIG. 15 is an elevation to smaller scale showing cam means for moving the first cutters relative to the side surfaces of a log.

The cutters 72, as shown in FIG. 14, are rotatably supported at the distal ends of arms 74—74, the proximal ends of which are pivotally mounted on pins 76—76 fixed in brackets 78—78, the brackets, in turn, being suitably fastened to the frame members 30*a*—30*a*. The arms 74—74 are movable arcuately about the axis of the pins 76—76 to and from the path of travel of the log and in order to press the cutters 72—72 against the surface of the log, air cylinders 80—80 are provided, each having a piston rod 82 pivotally connected by a pin 84 and a link 86 to the distal end of the arm 74. The air cylinders are double-ended so that air supplied to one end will move the arm 74 toward the path of movement of the log to press the cutter 72 into engagement with the surface and air supplied to the other end will retract the cutter.

Valve means is provided in the air lines so that the pressure of the cutters against the side surfaces of the log will remain constant regardless of variations in the proximity of the cutters to the side surfaces of the log, such valve means being, in effect, relief valves.

In accordance with this invention, to cause the cutters to follow the natural deviations in the surface of the log and to limit the depth of the cut, there are provided guides 78—78, FIGS. 8, 12, 13 and 14, mounted at the distal ends of the arms which, as shown in FIGS. 10, 12, 13 and 14, bear against the side surface of the log guiding the cutter inwardly and outwardly so as to follow the deviations in the surface and limit the depth of the cut. At the first station, there are two such guides 78—78, one at each side of the cutter, FIGS. 5 and 10, which, by engagement with the side surfaces of the log, limit the depth of the cut to, for example, 3/16 of an inch and which effect movement of the cutters inwardly and outwardly according to the deviations in the surface. At the succeeding stations, there is only one guide per cutter and this is arranged, as shown in FIGS. 12 and 13, to bear against the cut made previous to it so that the several successive cuts made along the length of the log contain the deviations of the first or center cuts. As shown in FIGS. 1 and 14, the flanking guides 78—78 have arcuate surfaces 90—90 which are concentric with the axes of rotation of the cutters and of radii which are greater than the radii of the cutters so that they have contact with the surface of the log sloping away from the cutters at each side. The guides contain elongate slots 92—92 and are fixed to the arms by means of bolts 94—94 so as to be adjustable relative to the arcuate surfaces of the cutters. The single guides at the several stations are similarly adjustable.

The cutters are driven by motors M, FIGS. 10 and 11, which are mounted on the arms 74—74, a motor for each cutter, sheaves 96 and 98 fixed, respectively, to the shaft 100 of the motor and the shaft 102 of the cutter and V-shaped belts 104—104.

If the side surfaces are to follow the deviations in the debarked side surfaces of the uncut log, the cutters are allowed to be guided by the engagement of the guides 78—78 with the side surfaces of the log. If, however, the side surfaces are to have some other contour, the cutters at the first station are programmed for movement toward and away from the sides of the log to make cuts in the side surfaces of the log independently of the contour of the side surfaces of the log. For example, in order to contour a four square log such as shown in FIG. 5, either to simulate the natural deviations of a log or to provide for a distinctive surface pattern such as shown in FIG. 7, the movement of the arms 74—74 toward and from the path of travel of the log is programmed by suitable means, for example, cams 106, FIG. 15, arranged to move the arms of the cutters at the first station inwardly and outwardly according to a predetermined pattern. The surface deviations generated at the first station by the programming as suggested will be duplicated at the succeeding stations by the guide 78 provided at the succeeding stations.

It should be understood that the present disclosure is for the purpose of illustration only and includes all modifications or improvements which fall within the scope of the appended claims.

I claim:

1. The method of planing logs comprising supporting, guiding and moving a log along a predetermined rectilinear path in a substantially horizontal plane, supporting at least two cutters adjacent the path of movement of the log at different peripheral positions about the log and at longitudinally-spaced positions along the path of travel with one of the cutters preceding the other for rotation about their centers and arcuate movement toward and from the side of the log, moving the cutters arcuately into engagement with the side of the log, yieldably supporting the cutters in engagement with the side of the log and, at said position of engagement, moving the one cutter transversely with respect to the path of movement of the log according to a predetermined pattern to form a cut of predetermined contour and depth and employing a pattern generated by the one cutter to effect movement of the other cutter transversely with respect to the path of movement of the log to reproduce the contour of the first cut at a different peripheral position on the surface of the log.

2. A method according to claim 1 comprising employing as the pattern the natural longitudinal contour of the log and employing the natural surface contour of the log to effect movement of the first cutter.

3. A method according to claim 2 wherein the movement of the one cutter transversely with respect to the path of movement of the log is effected by a follower yieldably held against the surface of the log as the log travels relative thereto.

4. A method according to claim 2 comprising planing and grooving diametrically-opposed sides of the log to provide diametrically-spaced, parallel, flat top and bottom surfaces, each of which contains a longitudinally-extending groove parallel to the longitudinal axis of the log and guiding the log by means engaged with one at least of the grooves.

5. A method according to claim 2 comprising planing the log to provide four square, spaced, parallel top, bottom and side surfaces and simultaneously grooving the top and bottom surfaces to provide longitudinally-extending grooves of predetermined rectangular section extending lengthwise of the top and bottom surfaces coinciding with the axis of the log and guiding the log by means of at least one of the grooves.

6. A method according to claim 1 wherein an arbitrary pattern is selected and employing the arbitrary pattern to effect movement of the first cutter.

7. A method according to claim 6 wherein the movement of the one cutter transversely with respect to the path of movement of the log is effected by a follower operating in a cam groove embodying the arbitrary pattern.

8. A method according to claim 1 comprising making a cut at one side which intersects the top surface at an angle such that the total width of the top surface is less than the total width of the bottom surface.

9. A method according to claim 1 comprising making cuts at the opposite sides which intersect the top surface at an angle such that the total width of the top surface is less than the total width of the bottom surface.

10. A method according to claim 1 comprising supporting the log while traveling along against lateral displacement and cutting the surface of the log at one side only.

11. A method according to claim 1 comprising supporting the log at the bottom side against lateral movement and applying a force to the top side to effect linear movement thereof.

12. A method according to claim 1 comprising applying a varying pressure to the cutting means to maintain a uniform surface pressure regardless of the lateral position of the cutting means.

13. A log-planing machine comprising a plurality of longitudinally-spaced supports for supporting a log for movement along a substantially horizontal path, means positioned above said supports for engagement with the upper side of a log resting on the supports, said means being operable to move the log along the supports, cutting instrumentalities located at longitudinally-spaced intervals along the path of movement of the log, said cutting instrumentalities being supported at different circumferential positions such as to collectively and successively remove material from the arcuate side surfaces of the log, said cutting instrumentalities being so distributed that a first set removes material from opposite sides of the log substantially at the center, and the succeeding instrumentalities remove material from the side surfaces above the center and below the center, guide means associated with the first cutting instrumentalities which, by engagement with the side surfaces of the log, cause the cutters to follow the natural contour of the log and to limit the depth of the cut, and means associated with the succeeding cutting instrumentalities adapted by engagement with the center cuts to cause the succeeding cutting instrumentalities to follow the contour of the first cuts and remove material to a corresponding depth.

14. A log-planing machine according to claim 13 wherein the supports comprise rollers supported for rotation about horizontal axes situated at right angles to the path of movement of the log.

15. A log-planing machine according to claim 14 wherein each roller has a rib peripherally thereof located between its opposite ends for engagement with a groove performed at the bottom side of the log for guiding the log rectilinearly.

16. A log-planing machine according to claim 13 wherein the means for moving the log along the supports comprise parts rotatable about horizontal axes above and at right angles to the path of movement having circumferential surfaces concentric with their axes of rotation adapted by rotation in engagement with the logs to move the logs along the supports.

17. A log-planing machine according to claim 13 wherein the means for moving the logs along said supports comprise tired wheels supported for rotation about horizontal axes at right angles to the path of movement with the tread surfaces of the tires in engagement with the top side of the log.

18. A log-planing machine comprising a supporting frame, means on the supporting frame for supporting a log for movement along a predetermined horizontal path, means supported above the supporting means at longitudinally-spaced intervals operable by engagement with a log resting on the supporting means to move the log along said path, cutting instrumentalities supported along the sides of the supporting means at longitudinally-spaced intervals operable to remove material from the sides at different peripheral positions and different longitudinal positions, guide means associated with the first of the cutting instrumentalities for causing the first of the instrumentalities to follow the curvature of the side surfaces of the log and limiting the cut to a predetermined depth, guide means associated with each of the succeeding cutting instrumentalities to cause it to follow the cuts made by the preceding cutting instrumentalities, and means yieldably holding the cutting instrumentalities in cutting engagement with the sides of the log as the log is moved relative thereto.

19. A log-planing machine according to claim 18 wherein the second-named means are wheels provided with tires supported with the tires in engagement with the top of the log and there is common means for effecting rotation of all of the wheels simultaneously and at the same speed.

20. A log-planing machine according to claim 18 wherein the cutting instrumentalities are rotating cutters and there is means connected to each respective cutter for effecting its rotation.

21. A log-planing machine according to claim 18 wherein an arm supports each cutting instrumentality for rotation about its axis and for movement in an arc relative to the side of the log and wherein the cutting instrumentality is a rotor rotatable about its center having peripherally thereof cutting elements and there is a motor supported by each arm and movable therewith for effecting rotation of the rotatable cutter.

22. A log-planing machine according to claim 18 wherein there is an elongate rib supported longitudinally of the path of movement of the log for engagement with a groove preformed at the bottom side of the log for guiding the log rectilinearly between said longitudinally-spaced supports.

23. A log-planing machine according to claim 18 wherein between successive longitudinally-spaced supports there are secondary supports comprising rigid bed plates having surfaces substantially tangent to the upper surface of the rollers and centrally located longitudinally thereof, said ribs being comparable in height to the ribs on the rollers for engagement with the preformed grooves in the log.

24. A log planing machine comprising a supporting frame, a plurality of longitudinally-spaced supports for supporting the log for movement along a substantially horizontal path, means positioned above the supports for engagement with the upper side of the log resting on the support, said means being operable to move the log along the support, cutting instrumentalities, means supporting the cutting instrumentalities along the path of movement of the log at different peripheral positions and in succession at longitudinally-spaced intervals along the path of movement for arcuate movement relative to the path of travel, means for moving the cutting instrumentalities into engagement with the surface of the log, means movable transversely with respect to the path of movement of the log according to a selected pattern to cause the first of the cutting instrumentalities in the succession of cutting instrumentalities to follow said selected pattern and means movable transversely with respect to the path of movement of the log according to the pattern generated by the first of the cutting instrumentalities in the succession of cutting instrumentalities to cause the successive cutting instrumentalities to reproduce the cut produced by the first of the cutting instrumentalities at different peripheral positions on the log.

25. Apparatus according to claim 24 wherein there are cutting means located at both sides of the path of travel of the log.

26. Apparatus according to claim 3 wherein there is means for withholding the cutting means at one side of the path of movement of the log.

27. A log-planing machine according to claim 24 wherein the cutting means at each station comprise a rotary cutter supported for movement into engagement with a side of the log traveling along said path and means at each station for moving the rotary cutter into engagement with the side of the log.

28. Apparatus according to claim 24 wherein there is means for maintaining each cutting means in contact with the side of the log at a uniform pressure while following the deviations in the side surface of the log.

29. A log-planing machine according to claim 24 wherein the cutting means at each station comprise two rotary cutters supported diametrically opposite each other at opposite sides of the path of movement of the log for rotation about spaced, parallel axes and means at each station yieldably pressing the rotary cutters into engagement with the sides of the log.

30. A log-planing machine according to claim 29 wherein the means for moving the rotary cutters into engagement with the log are air cylinders.

31. A log-planing machine according to claim 24 wherein the cutting means at the several stations are cutters, and there are means at each station supporting the cutters for rotation about their centers and for movement relative to the path of movement of the log toward and from the side surfaces thereof, means for moving the cutters into cutting engagement with the side surfaces of the log and means for effecting rotation of the cutters about their centers while in engagement with the side surfaces of the log.

32. A log-planing machine according to claim 31 wherein the means supporting the rotary cutters for movement relative to the path of movement of the log are arms, to one end of which the rotary cutters are rotatably mounted and means pivotally supporting the arms at their other ends for movement of their one end arcuately relative to the sides of the log.

33. A log-planing machine according to claim 24 wherein the guide members are adjustable relative to the cutting edge of the cutting means to enable varying the depth of the cut.

34. A log-planing machine according to claim 24 wherein the arcuate surfaces of the guides are substantially concentric with the axis of rotation of the cutters and of a radius greater than that of the cutters.

35. Apparatus according to claim 24 wherein the selected pattern is the natural longitudinal surface contour of the log and a follower, mounted on the means supporting the first of the cutting instrumentalities held in engagement with the surface of the log effects movement of the first of the cutting instrumentalities transversely with respect to the path of movement of the log according to the surface counters of the log.

36. Apparatus according to claim 35 wherein movement of the successive cutting instrumentalities are effected by followers mounted to the means supporting the cutting instrumentalities in positions to have engagement with the cut made by a preceding cutting instrumentality.

37. Apparatus according to claim 24 wherein the selected pattern is an arbitary pattern provided on the surface of a cam and a follower mounted to the means supporting the cutting instrumentality is positioned in engagement with the cam so as to follow the contour of the latter.

38. Apparatus according to claim 24 comprising means for yieldably holding the cutting instrumentalities engaged with the log.

39. A log planing machine comprising means for supporting, guiding and moving a log along a predetermined rectilinear path in a substantially horizontal plane, circular cutters in succession, supporting arms supporting the cutters at longitudinally-spaced positions along said path and at different circumferential positions about the axis of the log traveling along the path, said cutter supporting arms supporting the cutters for rotation about their centers and for arcuate movement toward and from the path of movement of the logs, means for moving and supporting the cutters yieldably engaged with the log, means mounted on the supporting arm of the first cutter extending radially from the center of rotation of the cutter in the succession beyond the peripheral cutting edge thereof for engagement with the surface of the log for causing the first of the cutters to follow the longitudinal contour of the log and means mounted on the supporting arms of the succeeding cutters and extending radially from the center of rotation thereof, so positioned as to have engagement with the surface generated by the first of the cutters to cause the succeeding cutters to reproduce the surface contour generated by the first cutter.

* * * * *